US007255648B1

(12) United States Patent
Romeo

(10) Patent No.: US 7,255,648 B1
(45) Date of Patent: Aug. 14, 2007

(54) PUTTING CUP FOR PRACTICING SPEED AND DIRECTION

(76) Inventor: David Joseph Romeo, P.O. Box 1004, Thayne, WY (US) 83127

( * ) Notice: Subject to any disclaimer, the term of this patent is extended or adjusted under 35 U.S.C. 154(b) by 15 days.

(21) Appl. No.: 11/269,472

(22) Filed: Nov. 7, 2005

(51) Int. Cl.
*A63B 69/36* (2006.01)

(52) U.S. Cl. ..... 473/180

(58) Field of Classification Search ..... 473/157–164, 473/171–174, 180–196
See application file for complete search history.

(56) References Cited

U.S. PATENT DOCUMENTS

| | | | | |
|---|---|---|---|---|
| 1,687,217 | A * | 10/1928 | Kurtz | 473/185 |
| 3,351,345 | A * | 11/1967 | Robinette | 473/184 |
| 3,606,339 | A * | 9/1971 | Marshall | 473/185 |
| 3,700,243 | A * | 10/1972 | Kenney | 473/180 |
| 4,275,886 | A * | 6/1981 | Bannon | 473/180 |
| D273,126 | S | 3/1984 | Turza | |
| 4,906,006 | A | 3/1990 | Sigunick | |
| 5,082,280 | A * | 1/1992 | Wang | 473/181 |
| 5,139,262 | A * | 8/1992 | Lai | 473/181 |
| 5,242,169 | A * | 9/1993 | Laabs et al. | 473/184 |
| 5,421,578 | A * | 6/1995 | Ames | 473/159 |
| 5,487,545 | A | 1/1996 | Schindler | |
| 5,573,247 | A * | 11/1996 | Ridge | 473/184 |
| 6,283,873 | B1 * | 9/2001 | Nunes | 473/180 |
| 6,623,371 | B2 * | 9/2003 | Corcoran | 473/184 |
| 2002/0107080 | A1 * | 8/2002 | Hsu | 473/191 |
| 2004/0005933 | A1 * | 1/2004 | Maruszczak | 473/192 |

* cited by examiner

*Primary Examiner*—Mark S Graham

(57) ABSTRACT

A practice putting cup which teaches a golfer correct putting speed as well as correct putting direction. To overcome imperfections on actual putting greens it is recognized that a putt must be struck with enough speed to not just reach the hole, but be capable of rolling approximately one to two feet past the hole. Further, if a putt is missed, ideally the putt will stop within two to three feet of the hole. Finally, a firmly struck centered putt will fall into the hole even if its speed could carry the ball as much as six to eight feet past the hole. This putting cup recognizes these ball putting speed (or distance) conditions and accordingly accepts or rejects holing putts. Thus the cup uniquely teaches correct speed as well as direction.

2 Claims, 1 Drawing Sheet

PUTTING CUP FOR PRACTICING SPEED AND DIRECTION

BACKGROUND OF THE INVENTION

1. Field of Invention

Figure 1:
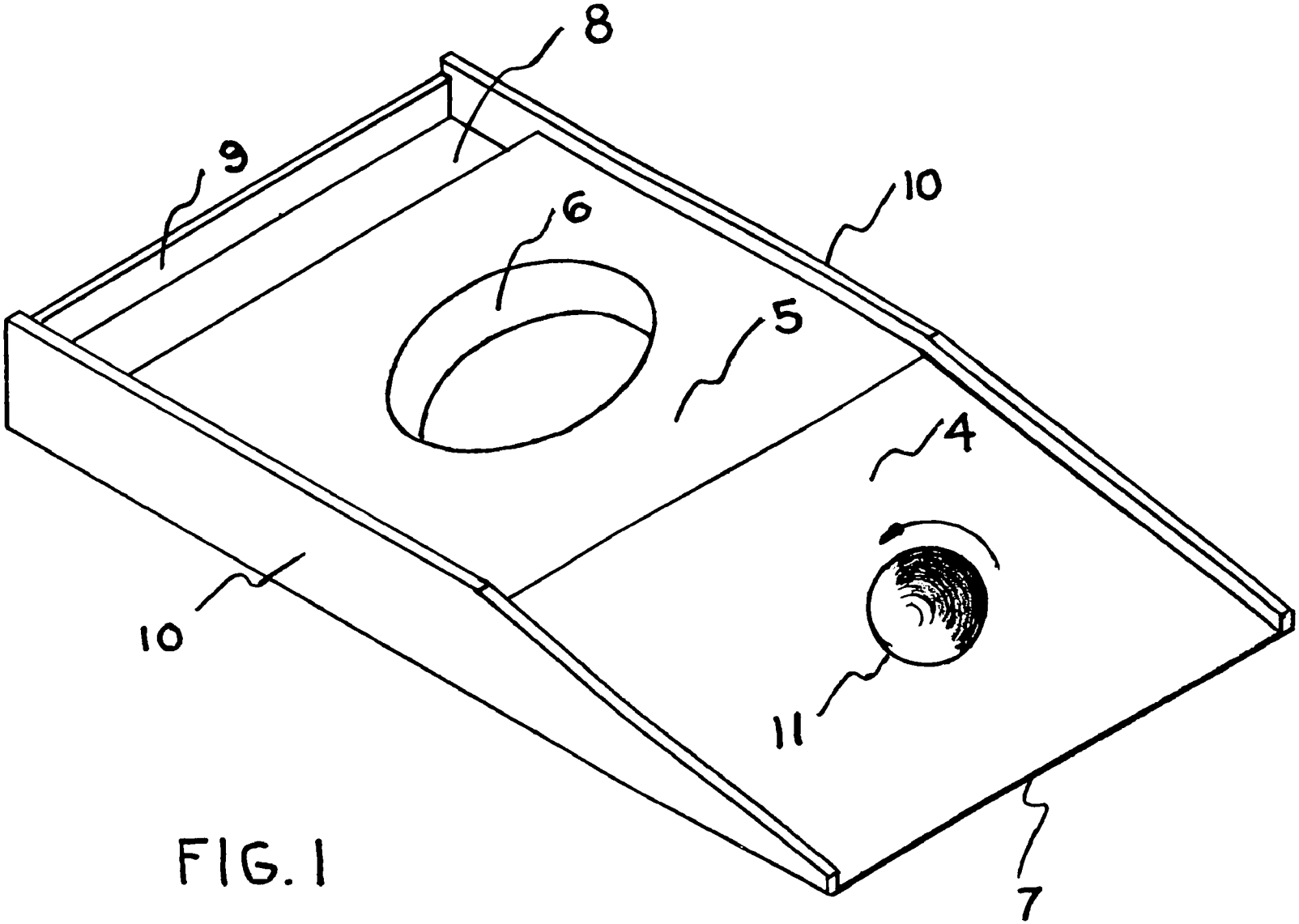

This invention relates to golf, specifically to an improved practice putting cup that teaches speed as well as direction.

2. Discussion of Prior Art

Numerous gadgets and aids are available for purchase by avid golfers in order to help improve their game. With regard to putting, there are a number of practice cups which may be placed on the golfer's carpet, or the golfer may purchase a piece of carpet or one of a number of specific golf mats simulating a putting green or surface.

Certain deficiencies exist with regard to these available cups. Since these cups of necessity must sit upon a carpet, they require some entry speed for the ball to pass over a ramp or lip. This in itself is not a bad feature since Reference 1 teaches that the ball speed at the front of the cup should be sufficient to roll the ball past the cup approximately 1 to 2 feet in order to optimize a putt's chance of being sunk on a real imperfect green surface. However, the ramps or lips on available cups are not designed for this purpose, see, e.g., Patent Des. 273,126 to Turza, 1984. A simulated putting cup designed to be placed upon rather than into a carpet must be of a type wherein the ball rolls up a ramp and/or over a lip in order to fall into a hole the depth of which can be no more than back down onto the carpet surface. Portable or stand-alone cups on the market are almost all of the ramp type. A distinction between these cups is that they are omnidirectional, i.e., the putt can enter from any direction or they are unidirectional where the putt can only enter from one direction. The latter type can be referred to as planar ramp, "horseshoe" design. Patent Des. 273,126 to Turza, 1984 is typical of a "horseshoe" design. U.S. Pat. No. 5,487,545 to Schindler, 1996 and U.S. Pat. No. 4,906,006 to Sigunick, 1990 are of the omnidirectional type. While putting from any direction may be convenient, this design has serious drawbacks. Since the putt must travel up a conical ramp, any ball which is not putted exactly on the centerline of the hole will be deflected to one side or another as it rolls up the conical shaped ramp (like the sides of a volcano).

U.S. Pat. No. 4,906,006 is unrealistic in several areas. The putting speeds at which putts are holed are incorrect because of the severe ramp angle 22 to 26 degrees and the shallowness of the cup, which is ⅜ inch maximum. Thus the speeds of sinkable putts on actual greens are quite different from the speed and direction of sinkable putts using omnidirectional cups. As opposed to a planar ramp, the conical ramp as also claimed in U.S. Pat. No. 5,487,545 completely deviates from putting on an actual green as it turns putts not exactly on center away from the cup. A flat cup on an actual green does not behave in this manner. Hence, these cups are difficult and frustrating to use as putting training devices. Finally, with these devices as well as with all others on the market, a missed putt provides no feedback with regard to proper speed.

OBJECTS AND ADVANTAGES

My invention adds greatly to the field of putting training devices with regard to teaching correct putting speed. On an actual green there exists an optimum range of putting speeds as discussed in detail by Pelz, Reference 1. Pelz teaches that to overcome imperfections on actual putting greens, a putt must be struck with enough speed to not just reach the hole, but be capable of rolling approximately one to two feet past. Further, if a putt is missed, ideally the putt will stop within two or three feet of the hole. Finally, a firmly struck centered putt will fall into the hole even if its speed could carry the ball as much as six to eight feet past the hole.

This putting cup invention recognizes these ball putting speed (or distance) conditions and accordingly accepts or rejects holing putts. Thus, the cup uniquely teaches correct speed as well as direction.

No cups on the market or putting cup patents have considered or attempted to teach proper putting speeds. For example, five practice putting cups on the market were tested to see how far a centered putt could roll past the location of the center of the hole and still drop, i.e., not bounce over. The worst cup tested let centered balls bounce over the cup which would otherwise travel as little as two feet past. The best cup tested, that which is patented as U.S. Pat. No. 5,487,545, allowed centered balls to drop which would otherwise travel up to four feet past. The results of all the other cups fell between these results. My invention will drop centered putts able to roll up to; eight feet past just as occurs on actual putting greens.

The present invention will:

- Reject putts that are not struck firmly enough to be capable of rolling one to two feet past the hole.
- Capture putts behind the hole (those which miss to the left or right) which would be capable of rolling only two to three feet past the hole. Faster putts would roll over the capture means.
- Allow very firm, centered putts to drop into the hole rather than bounce over. These are putts which would fall into the hole on actual greens and would be capable of rolling some six to eight feet past the hole.

SUMMARY

The present invention is a practice putting cup which teaches a golfer correct putting speed as well as direction. Optimum speed is that firmness of the struck putt which would roll a ball one to two feet past the hole. The invention rejects putts which are not sufficiently firm, i.e., would roll less than one foot past and captures, behind the hole, missed putts which would travel up to three feet past the hole. Additionally, a firmly struck centered putt will drop into the hole for speeds which would carry the ball as much as six to eight feet past the hole as would occur on an actual putting green. The invention discriminates these speeds by a planar ramp design in front of the hole, by a trough of specific size behind the hole, and by the actual depth of the hole. The invention has a ramp and surface width sufficient to allow putts missed left and right of the hole by a significant margin to still provide feedback with regard to proper speed.

DRAWING FIGURES

FIG. 1 is an isometric sketch of the putting cup invention which presents an overall view and identifies the various components thereof.

REFERENCE NUMBERS IN DRAWINGS

| | |
|---|---|
| 4 | Ball entry ramp |
| 5 | Hole surface |
| 6 | Hole (USGA regulation size) |

-continued

| | |
|---|---|
| 7 | Front edge (of ball entry ramp) |
| 8 | Ball retention trough |
| 9 | Rear retainer |
| 10 | Side wall(s) of cup |
| 11 | Golf ball |

DETAILED DESCRIPTION

Preferred Embodiment FIG. 1

The preferred embodiment of the putting cup is shown in FIG. 1. The putting cupis rectangular in planform approximately two regulation golf hole diameters in width by three and one half diameters in length. It has a planar "ball entry ramp" 4 of approximately 10 degrees slope by three quarters of a golf ball diameter in height with a "front edge" 7 radius of less than one thirtieth of a golf ball diameter. With the putting cup placed upon a carpet or actual putting green of average speed, Stimpmeter reading 9 to 10, a ball putted with optimum speed and direction will roll longitudinally up the center of ramp 4 onto adjoining "hole surface" 5 and drop into regulation size "hole" 6. Hole surface 5 is also approximately three quarters of a golf ball diameter in height and hole 6 is greater than one half golf ball diameter in depth. If the hole surface were not flat but rather a continuation of the ramp, putted balls which miss to the left or right of the hole can roll back down the ramp. Optimum speed putts then could not be correctly delineated. Optimum speed means that if the putting cup were not present the ball would roll one to two feet past the position of the rear of the hole. A golf ball putted left or right of hole 6 within one half a hole diameter of the edge of the hole will roll into "trough" 8. The trough is approximately three quarters of a ball diameter front to back. The ball will either be stopped by "rear retainer" 9 which is approximately one fourth of a ball diameter in height and stay in the trough or the ball will hop over if its speed would roll it more than three feet past the hole were the putting cup not present. Missed puts which contact the inside of "side wall(s)" 10 will be directed into trough 8 thus increasing the width of missed putts for which putting speed feedback is provided.

The putting cup can be constructed of wood with or without a softer fabric surface or it can be one-piece molded of a suitably resilient plastic or rubber material.

Operation of Invention FIG. 1

The putting cup FIG. 1 is designed to teach putting speed as well as the normal use of practice putting cups which is to teach direction. In the game of golf, putting speed is discussed, but it is always described in terms of how far a golf ball rolls with respect to the hole. Speed and distance are related on a flat surface through the energy balance equation:

$$\tfrac{1}{2}mv^2=\mu mgS$$

where m ball mass v ball speed

μ coefficient of rolling friction g gravitational constant

S distance

This equation states that the kinetic energy of the ball is dissipated due to frictional effects as the ball rolls distance S.

The invention is designed to recognize three critical speeds and discriminate accordingly. These speeds equated and presented as distances the ball could roll past the hole are as follows:

$S_o$ optimum distance, one to two feet; based upon the results of Pelz, Reference 1

$S_t$ tap-in distance, two to three feet; maximum distance one would want a missed putt to travel in order to have a very strong chance of sinking the next putt $S_m$ make-able distance, six to eight feet; maximum distance a centered putt could otherwise travel and still drop into the hole, see again Reference 1.

These distances were equated to velocities using the above equation and a coefficient of rolling friction measured on a selected carpet with performance equal to a putting green of average speed, that is a "green speed" Stimpmeter reading of 9-10. Stimpmeter reading is the accepted method for quantitatively defining "green speed". Green speed is relatively how fast a golf ball rolls on an actual green, see again Reference 1.

The front edge 7 radius and ball entry ramp 4 slope and height were designed to recognize $S_o$. If the ball speed is below that which equates to $S_o$ the ball will not make it up to the top of the ramp and will roll backwards back down. A ball putted at a speed which does not equate to at least $S_o$ can not drop into the hole. A specific minimum and optimum firmness of putt is then taught.

Every practice putting cup on the market which was tested failed to meet this firmness of putt requirement. They all allowed more weakly struck putts to be holed.

With every practice cup on the market if the putt is missed to the left or right nothing more can be taught other than that the direction was incorrect. With the present invention if the putt is missed its second critical distance, $S_t$ is recognized by ball retention trough 8 and rear retainer 9. If the missed putt ball speed is greater than that to satisfy $S_o$ but less than that to satisfy $S_t$ the ball will roll into trough 8 and be held by rear retainer 9. If the speed is greater the ball will hop over retainer 9.

Entry ramp 4 and hole surface 5 are sufficiently wide, two hole diameters, to accommodate a wide range of missed putts. The raised side walls 10 of the invention further extend the range of missed putts which can be measured for speed.

If a golf ball is putted quite firmly on an actual green, measurements show that if the putt is on center with the hole, the ball, can drop into the hole even if it could otherwise roll as much as six to eight feet past.

As a golf ball travels in free space between the front and back edges of a hole the ball free-falls due to gravity. If the speed is not excessive the ball will have time to free-fall more than one half a ball diameter such that the center of mass of the ball will be below the height of the back of the hole when the ball strikes the back lip. In theory then, this ball stands a good chance of rebounding off the inside surface at the back of the hole and dropping into the hole. If, however, the depth of the hole in a practice cup is less than one half a ball diameter, the free-falling ball will simply hit the surface at the shallow bottom of the hole and can therefore unrealistically bounce up and hop over the back of the hole. It might seem evident that a practice putting cup should be deep enough to simulate a hole on an actual green. Yet, every practice cup on the market that has been designed to be: placed upon a putting surface fails to recognize this important aspect. They are all too shallow. The present invention has a hole depth greater than a half ball diameter and hence is the only one which allows very firm putts to drop into the hole as would occur on actual putting greens.

CONCLUSIONS, RAMIFICATIONS, AND SCOPE

Thus, the reader will see that my practice putting cup invention provides a training aid to serious golfers which goes far beyond anything presently available. By teaching proper putting speed as well as direction, the invention will contribute significantly to improving a golfer's putting skills.

While my above description contains many specificities, those should not be misconstrued as limitations of the scope of my invention, but rather as an exemplification of one preferred embodiment thereof.

Other variations are possible. For example, the invention has a flat bottom, not shown, for use on any suitable putting surface, carpet, or actual putting green. It could be provided with small cleats or projections at the four corners of the bottom to prevent movement when the back of the hole is firmly struck with a golf ball. The invention for cost consideration will most probably be molded from a suitable resilient plastic, but an additional more expensive version could be of a fine wood such as maple, oaks or walnut with a quality green felt surface such that the cup can be presented as a gift, prize, or golf trophy for example for a "hole-in-one" trophy. A trophy that had an actual use certainly would be unusual. Additionally, if the golfer's use was predominantly to learn speed as opposed to direction the invention could be supplied with a plug to fill the hole. This would allow the full width to be used solely for speed or distance training.

Another, version of the invention would be the inclusion of a practice putting carpet or mat on which to place the putting cup. The size for this carpet, based upon extensive testing, would be approximately 20 inches in width by 10 to 12 feet in length. The carpet would be provided with a predetermined Stimpmeter performance, for example 8, 10, or 12. This would enable the serious golfer to experience known, exact putting conditions for practice in his home which would duplicate the green speed conditions of actual course greens that the golfer is accustomed to playing.

Accordingly, the scope of the invention should be determined not by the embodiment illustrated, but rather by the appended claims and their legal equivalents.

I claim:

1. A practice putting cup comprising:

a rectangular planform shape with a minimum width equal to two times a regulation golf hole diameter;

a golf ball entry ramp of approximately ten degrees incline angle with a height approximately equal to three quarters of a golf ball diameter;

a flat hole surface adjoining and at the height of the entry ramp into which a hole of regulation size diameter is centrally located;

a regulation size hole cut into the flat hole surface to a depth greater than one half diameter of a golf ball;

side walls which extend above the height of the entry ramp and the flat hole surface;

a lateral trough to the rear of the hole with a rear lip or retainer of a height of approximately one fourth of a golf ball diameter and specifically of a height lower than that of the side walls of the cup;

wherein the entry ramp will turn back or reject putts that are not struck firmly enough to be capable of rolling one to two feet past the hole and further the lateral trough will retain only those putts missed left and right of the hole which would otherwise roll no more than three feet past the back of the hole, and wherein struck too firmly which miss the hole will roll through the lateral trough and over the rear lip so that the cup as a whole will turn back weak putts, but at the same time expel missed putts that were struck too firmly.

2. A practice putting cup comprising:

a rectangular planform shape with a golf ball entry ramp and a flat hole surface;

a golf hole cut into the flat hole surface;

side walls which extend above the height of the entry ramp and the flat hole surface;

a lateral trough behind the hole with a rear lip or retainer of a height approximately one fourth of a golf ball diameter and specifically of a height lower than that of the side walls of the cup;

whereby the lateral trough will retain only those putts missed left or right of the hole which would otherwise roll no more than three feet past the back of the hole.

* * * * *